US008803453B2

(12) United States Patent
Eaton et al.

(10) Patent No.: US 8,803,453 B2
(45) Date of Patent: Aug. 12, 2014

(54) ACCELERATOR SYSTEM STABILIZATION FOR CHARGED PARTICLE ACCELERATION AND RADIATION BEAM GENERATION

(75) Inventors: Douglas W. Eaton, Las Vegas, NV (US); Gongyin Chen, Henderson, NV (US); Timothy R. Fox, Chicago, IL (US)

(73) Assignee: Varian Medical Systems, Inc., Palo Alto, CA (US)

( * ) Notice: Subject to any disclaimer, the term of this patent is extended or adjusted under 35 U.S.C. 154(b) by 369 days.

(21) Appl. No.: 13/134,989

(22) Filed: Jun. 22, 2011

(65) Prior Publication Data

US 2012/0326636 A1 Dec. 27, 2012

(51) Int. Cl.
*H05H 7/02* (2006.01)

(52) U.S. Cl.
USPC ..... 315/501; 315/500; 315/504; 315/505; 315/506; 250/505.1; 250/492.3

(58) Field of Classification Search
CPC ..... H05H 7/02
USPC ..... 315/500, 501, 505
See application file for complete search history.

(56) References Cited

U.S. PATENT DOCUMENTS 3,965,434 A * 6/1976 Helgesson ..... 315/500
5,434,420 A * 7/1995 McKeown et al. ..... 250/396 R
5,801,488 A * 9/1998 Fujisawa ..... 315/5.41
6,462,489 B1 * 10/2002 Roberge et al. ..... 315/505
7,242,158 B2 * 7/2007 Whitham et al. ..... 315/505
7,310,409 B2 * 12/2007 Tanaka ..... 378/137
7,402,821 B2 * 7/2008 Bernhardt ..... 250/492.21
2010/0038563 A1 2/2010 Chen et al.
2010/0177873 A1 7/2010 Chen et al.

OTHER PUBLICATIONS

G. Chen et al, "Dual Energy X-ray radiography for automatic high-Z material detection," Nuclear Instruments and Methods in Physics Research B, vol. 261 (2007), pp. 356-359.

* cited by examiner

*Primary Examiner* — Alexander H Taningco
*Assistant Examiner* — David Lotter
(74) *Attorney, Agent, or Firm* — Cozen O'Connor; Brandon N. Sklar

(57) ABSTRACT

A method for generating stabilized particle acceleration by a radio-frequency (RF) accelerator is described, comprising operating the accelerator in a warm-up mode during a warm-up time period, without injecting charged particles or without accelerating injected charged particles, and operating the accelerator in a beam-on mode during a beam-on time period after the warm-up time period, to accelerate charged particles injected by the charged particle source. Automatic frequency control to match an expected frequency of the accelerator during the beam-on time period, prior to the start of the beam-on time period, for stability, is also described.

22 Claims, 10 Drawing Sheets

ACCELERATOR SYSTEM STABILIZATION FOR CHARGED PARTICLE ACCELERATION AND RADIATION BEAM GENERATION

FIELD OF THE INVENTION

Charged particle accelerator systems and, more particularly, charged particle accelerator systems and methods for stabilizing charged particle acceleration and radiation beam generation.

BACKGROUND OF THE INVENTION

Radiation is widely used in interrogation and irradiation of objects, including people. Examples of interrogation include medical imaging, cargo imaging, industrial tomography, and non-destructive testing (NDT) of objects. Examples of irradiation include food irradiation and radiation oncology. Accelerated charged particles, such as protons, are also used in radiation oncology.

Radio-frequency ("RF") accelerators are widely used to accelerate charged participles and to produce radiation beams, such as X-rays. RF accelerator based radiation sources may operate in a pulsed mode, in which charged particles are accelerated in short pulses a few microsecond long, for example, separated by dormant periods. Some applications require a "steady state" radiation beam, in which each pulse of radiation is expected to be the same. Other applications, such as cargo imaging, may use interlaced multiple energy radiation beams, as described, for example, in U.S. Patent Publication No. 2010/0038563A1 ("the '563 Publication"), which was filed on Aug. 12, 2008, is assigned to the assignee of the present invention, and is incorporated by reference herein.

FIG. 1 is a block diagram of major components of an example of an RF accelerator system 10 configured to generate radiation. The system 10 comprises an accelerator (also called beam center line ("BCL")) 12. An RF source 14, which may be a magnetron or a klystron, provides RF power to the accelerator 12, through an RF network 16. The RF network 16 ensures that the RF source 14 is properly coupled with the accelerator 12, and isolates the RF source from reflected RF power and the frequency pulling effect caused by the accelerator. The RF network typically includes a circulator and an RF load (not shown). A charged particle source 18 injects charged particles into resonant cavities (not shown) of the accelerator 12, for acceleration. A target 20, such as tungsten, is positioned for impact by the accelerated charged particles, to generate radiation by the Bremsstrahlung effect, as is known in the art. To generate X-ray radiation, the charged particle source may include a diode or triode type electron gun, for example.

The RF source 14 is maintained in a "ready to generate" RF condition by a filament heater (not shown). The external surface of the RF source is usually temperature controlled. The charged particle source 18 also includes a filament heater (not shown) so that the particle source is ready to inject particles when requested.

An electric power supply 22 provides electric power to the RF source 14 and the charged particle source 18. The electric power supply is controlled by a controller 24, such as a programmable logic controller, a microprocessor, or a computer. An automatic frequency controller ("AFC") 26 is provided to match the resonance frequency of the accelerator 12 with the frequency of the RF source 14, as described in the '563 Publication, identified above.

When a beam-on command is provided to the controller 24 by an operator, for example, the controller 24 turns on the electric power supply 22 to provide electric power to the RF source 14 and to the charged particle source 18. The electric power may be provided in the form of pulses of a few microseconds each, at a rate of up to a few hundred pulses per second, for example. The RF source 14 generates standing or travelling electromagnetic waves in the resonant cavities of the accelerator, which bunch and accelerate charged particles injected by the charged particle source 18. In this example, accelerated charged particles are directed toward the target 20. Impact of the accelerated charged particles on the target 20 causes generation of radiation by the Bremsstrahlung effect, as mentioned above at a corresponding radiation pulse length and rate. The electric power supply 22 is turned off when radiation is no longer desired. A beam-off command may be received from an operator or the controller may be programmed to end beam generation after a predetermined period of time. A beam run may last for seconds, minutes, or hours between a beam-on command and a beam-off command, for example. When radiation is desired again, the electric power supply is turned on again. Accelerated charged particles may also be used directly, in which case the target 20 is not necessary.

Typically, the RF pulses substantially coincide with particle injection in time. The RF generation and particle injection can also be controlled to only partially overlap in time, to control radiation output, as described in U.S. Patent Publication No. 2010/0177873, assigned to the assignee of the present invention and incorporated by reference herein.

The stability of a generated radiation beam may vary from the beginning to the end of the radiation beam. See, for example, Chen, Gongyin, et. al., "Dual-energy X-ray radiography for automatic high-Z material detection," Nuclear Instruments and Methods in Physics Research Section B: Beam Interactions with Materials and Atoms Vol. 261, Issues 1-2, August 2007, pp. 356-359. FIG. 2 is a graph of normalized radiation dose versus time for a continuous radiation beam 2*a* generated for over 300 seconds by a Varian M9 Linatron®, available from Varian Medical Systems, Inc, Palo Alto, Calif., based on actual test results. The continuous radiation beam 2*a* in this example comprises radiation pulses generated at a rate of several hundred pulses per second. Each pulse may last a few microseconds. These microsecond pulses are not indicated. In this example, the dose rate drops about 10% from a peak dose 2*b* at the very beginning of the radiation beam to a more steady dose rate after about 150 seconds. The energy of the radiation beam may vary, as well.

FIG. 3 is a graph of normalized radiation dose rate versus time for a plurality of shorter radiation beams 3*a*-3*h*, by the same Varian Linatron® during a cycle beam run. In this example, each radiation beam 3*a*-3*h* extends for a 10-second beam-on time period separated by a 5-second beam-off time period. In each 10-second beam-on period, the dose rate drops about 6% from an initial peak at the start of each beam. As above, each radiation beam 3*a*-3*h* comprises microsecond pulses of radiation microseconds long, generated at a rate of several hundred pulses per second. The energy of each radiation beam may vary, as well. Other commercially available linear accelerators may show instabilities similar to those shown in FIGS. 2 and 3.

SUMMARY OF THE INVENTION

While acceptable for many applications, variations in dose and energy can negatively impact results in certain applications, which require more stable radiation dose and energy during the entire time the radiation beam is generated, starting from the initial generation of the radiation beam. In object and cargo imaging, for example, reliable material discrimination and/or identification require stable X-ray beam energy and dose output. In the case of interlaced energy radiation pulses, each pulse series needs to be stable. Due to radiation safety concerns and throughput requirements, it is not practical to turn the X-ray beam on, wait for it to stabilize, and then scan an object. In cancer therapy, there are also strict radiation beam quality (and quantity) requirements.

Various sources of potential instability may be present in an accelerator system. For example, it has been found that if the RF power has been off for long enough, the RF source reaches an RF-off thermal equilibrium state at a lower temperature than its RF-on thermal equilibrium state. After electric power starts to be provided to the RF source, it reaches an RF-on thermal equilibrium state. A rapid transition from the RF-off thermal equilibrium state to the RF-on thermal equilibrium state may cause RF output power and/or frequency to vary when the beam is first turned on, resulting in a change in radiation beam energy and dose output.

Another example is the RF network, where insertion loss of the RF network components, primarily the RF circulator, may drift during similar transitions between thermal equilibrium states. Changes in insertion loss may lead to changes in RF power transmitted to the accelerator.

The accelerator is another potential source of instability, in part because the resonance frequency of the accelerator is susceptible to small temperature changes. As the accelerator is heated by RF power, it expands, causing slow frequency drift of the resonance frequency of the accelerator as the accelerator approaches thermal equilibrium. Such drift is most noticeable in the first minute or two of operation. The resonant frequency of the accelerator also varies in response to environmental changes, including ambient temperature. Changes in resonant frequency can cause a frequency mismatch with the RF source and RF network, increasing reflected RF power and weakening the electromagnetic field within the accelerator, resulting in reduced radiation beam energy. A frequency servo or automatic frequency controller ("AFC") is typically used to track the overall frequency shift of the accelerator resonant cavities. However, the AFC may not fully compensate for frequency shifts in individual cavities.

The charged particle source is another potential source of instability. The injection of charged particles into the accelerator may cool the charged particle source, while some charged particles may be forced back into the charged particle source by the accelerator, which may heat the source. Therefore, at the beginning of charged particle injection, the particle source also experiences a transition between thermal equilibrium states, which may change characteristics of the particle population pulled out of the source, such as their emittance characteristics (position and vector velocity at a given time). This may affect bunching and acceleration by electromagnetic field in the accelerator.

Embodiments of the present invention allow at least certain components of the accelerator system to transition from their "beam-off" thermal equilibrium state to their "beam-on" thermal equilibrium state in a warm-up time period prior to the acceleration of injected charged particles and radiation beam generation, thereby improving stability of the accelerated charged particles and radiation beam.

In accordance with one embodiment, a stabilized radio-frequency ("RF") accelerator system is disclosed comprising an RF accelerator to accelerate charged particles, an RF source coupled to the accelerator to provide RF power into the accelerator, a charged particle source coupled to the accelerator to inject charged particles into the accelerator, and at least one electric power supply coupled to the RF source and the charged particle source to provide electric power to thereto. At least one controller is provided, configured to cause supply of electric power from the at least one electric power supply to at least one of the RF source and the charged particle source without accelerating charged particles injected by the charged particle source, during a warm-up time period, and cause supply of electric power to the RF source and to the charged particle source during at least partially overlapping times, to accelerate charged particles injected by the charged particle source, during a beam-on time period.

In accordance with another embodiment, a stabilized radio-frequency ("RF") accelerator system is disclosed comprising RF accelerator means for accelerating charged particles, RF power means for providing RF power to the RF accelerator means, charged particle means for providing charged particles to the RF accelerator means, and electric power means for providing electric power to the RF source and the charged particle source. Means are also provided for causing supply of electric power to at least one of the RF power means and the charged particle means without accelerating charged particles injected into the accelerator by the charged particle means, during a warm-up time period. Means are also provided for causing supply of electric power to both the RF power means and the charged particle means to cause acceleration of charged particles, during at least partially overlapping time periods within a beam-on time period.

In accordance with another embodiment, a method for generating stabilized particle acceleration by a radio-frequency (RF) accelerator is disclosed comprising operating the accelerator in a warm-up mode during a warm-up time period, without accelerating charged particles injected by a charged particle source and operating the accelerator in a beam-on mode during a beam-on time period after the warm-up time period, to accelerate charged particles injected by the charged particle source.

In one example of an embodiment, an electric power supply provides electric power to the RF power components (the RF power supply, RF network, and accelerator), without providing electric power to the charged particle source. The RF power components can therefore warm up before particle acceleration and radiation generation, minimizing transition times between beam off/on thermal equilibrium states of the RF power components.

In another example of an embodiment, a variable delay line delays the supply of electric power pulses to the charged particle source so that electric power is provided to (1) the charged particle source, and (2) the RF source, RF network, and accelerator, at different times. In this case the charged particle source, as well as the RF components can warm up and transition to their thermal equilibrium states prior to particle acceleration and/or radiation generation.

In another example of an embodiment, separate electric power supplies provide electric power to the RF source and the charged particle source at different times to the RF power components and the charged particle source to also warm up and transition to their thermal equilibrium states prior to charged particle acceleration and/or radiation beam generation.

It has also been found that there may be a small difference between the accelerator's resonance frequency with and without particle injection. In accordance with another embodiment of the invention, at or near an end of a warm up period and prior to a start of beam generation in the beam-on time period, the AFC adjusts the RF source frequency to match an expected resonance frequency of the accelerator during the beam-on time period. In one example of this embodiment, this may be done by adjusting the RF source frequency to the actual resonance frequency of the accelerator plus a delta (Δ) representing the expected difference, in a time period between a last warm-up electric power pulse and a first beam-on electric power pulse, for example. By the time the first beam-on electric power pulse is delivered, the AFC returns to matching the RF source frequency to the actual resonance frequency of the accelerator. When particle acceleration and radiation beam generation starts in the beam-on time period, the RF source frequency will already be at or near the resonance frequency with particle injection, facilitating faster frequency locking and a more stable radiation beam.

DESCRIPTION OF THE PREFERRED EMBODIMENTS

Figure 4:
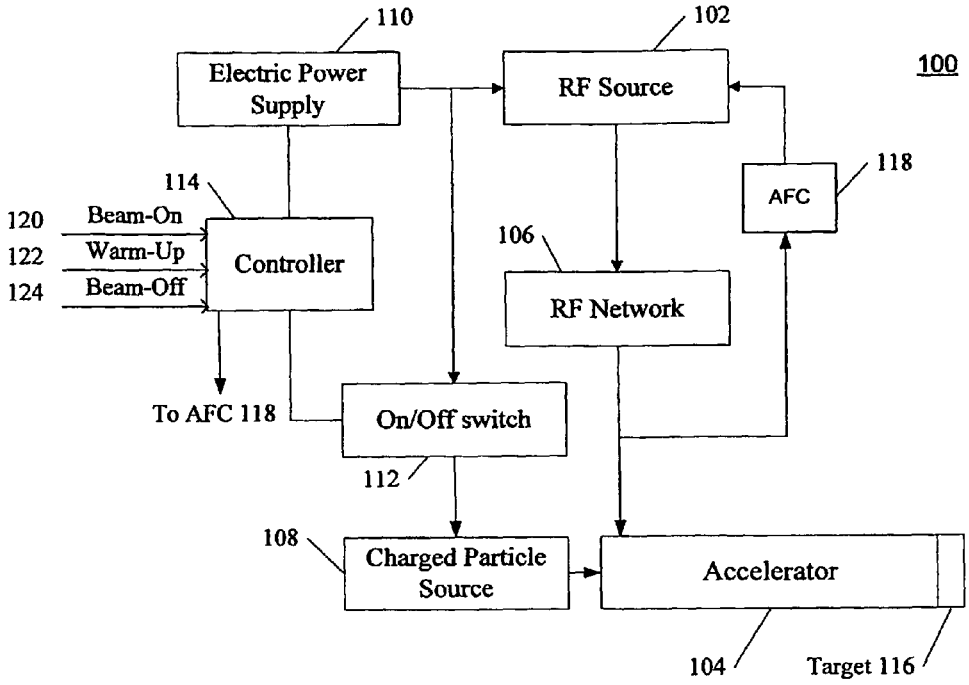
FIG. 4 is an example of an RF accelerator system configured to generate radiation beams with improved stability, in accordance with one embodiment of the invention.

FIG. 4 is an example of an RF accelerator system 100 configured to generate more stable radiation beams, in accordance with one embodiment of the invention. In this example, an RF source 102 provides RF power to an RF accelerator 104 through an RF network 106, and the charged particle source 108 injects charged particles to the accelerator, as described above. An electric power supply 110 provides electrical power to the RF source 102 and the particle source 108. In accordance with this embodiment, an on/off switch 112 is provided between the electric power source 110 and the particle source 108, enabling electric power to be provided to the RF source 102 without being provided to the particle source. A controller 114, such as a programmable logic controller, a microprocessor, or a computer controls the electric power source 110 and the on/off switch 112, in response to input signals from an operator and/or programming. A target 116 is provided for radiation generation. Automatic frequency controller ("AFC") 118 may be provided between accelerator 104 and the RF source 102, under the control of the controller 118 or other such controller.

The RF accelerator 104 may be an electron linear accelerator comprising a plurality of electromagnetically coupled resonant cavities (not shown), such as a Linatron® available from Varian Medical Systems, Inc., Palo Alto, Calif. The RF accelerator 104 may be another type of accelerator that uses RF power to accelerate charged particles, such as a cyclotron, as well. The RF source 102 may comprise a klystron or a magnetron. To generate X-ray radiation, the charged particle source 108 may be an electron gun, such as a diode or triode type electron gun, as discussed above. The target 116 may comprise tungsten, for example.

The electric power supply, also referred to as a modulator, may comprise a high voltage power supply ("HVPS"), a pulse forming network ("PFN"), and a thyratron (not shown). One or more transformers (not shown) may be provided, as well. Electric power supplies are described in more detail in the '563 Publication, which is incorporated by reference herein and identified more fully, above. The transformer may be coupled to an output of the PFN, the input of the RF source 102, and the switch 112. In one example, the HVPS outputs 22,000 volts, which is increased to about 40,000 volts by the transformer and provided to the RF source 102, as described in the '563 Publication. The electric power supply may also comprise a solid state modulator, for example.

The AFC 118 samples RF signals that go to and are reflected from the accelerator 104, to detect the frequency matching condition and adjust the frequency of the RF source 102, if necessary, to match the resonant frequency of the accelerator. The RF signal may be sampled between the RF source 102 and the circulator (not shown) in the RF network 106, instead. The sampling times may be controlled by the controller 114 or other such controller, for example.

The AFC 118 may be based on a quadrature hybrid module and an adjustable phase shifter, which are commercially available. AFCs of this type are described in U.S. Pat. No. 3,820,035, which is incorporated by reference herein, for example. In the system described therein, a microwave circuit accepts a reflected ("REF") signal, and a forward ("FWD") signal, and generates vector sums of the two signals with various relative phase shifts. The amplitudes of those vector sums are measured and the need to adjust RF source frequency is determined by electronic circuitry or software incorporated in the AFC 118, the controller 114 or other such controller. The output signal of the AFC 118 may be employed in a feedback loop to the RF source 102. Over multiple cycles, the frequency of the RF source 102 approaches the resonance frequency of the accelerator. AFC operation is described in more detail in the '563 Publication, which is incorporated by reference herein.

In one example, the on/off switch 112 handles a few amperes of electric current and up to several thousand volts provided by the electric power supply 110. The switch 112 may comprise an electrically controlled mechanical switch, for example. Faster switching may be provided by solid state switches, such as a bank of field effect transistors ("FETs"). Suitable FETs include insulated-gate bipolar transistors ("IGBTs"), insulated-gate FETs, or metal oxide semiconductor FETs, for example.

In operation, prior to sending a radiation beam-on command along line 120 to the processor 114, in this example a warm-up command is sent by an operator, along line 122. In response to the warm-up command, the controller 114 operates in a warm-up mode to turn the electric power supply 110 on and to gate the on/off switch 112 to an off state or position, if it is not already in the off position, so that electric power is provided to the RF source 102 without being provided to the charged particle source 108.

While electric power is provided to the RF source 102, the RF source will provide RF power to the accelerator 104, through the RF network 106, either continuously or in repeated short pulses, as in this example, depending on accelerator design. The electric power provided to the RF network 106 and the accelerator 104 cause these components to warm-up and approach or reach their beam-on thermal equilibrium states, depending on how long the RF power is on prior to receipt of the beam-on command and charged particle acceleration. Since no electrical power is provided to the charged particle source 108, injected charged particles are not accelerated. No radiation beam will be generated by the system 100, from the impact of accelerated charged particles injected by the charge particle source 108.

It is noted that during the warm-up time period, electromagnetic waves propagating within the resonant cavities of the accelerator 104 may draw electrons from the accelerator walls. Such electrons may be accelerated and could impact the wall of the accelerator in another location, causing incidental radiation generation. It is the intended particle acceleration and radiation generation from acceleration of charged particles injected by the charged particle source 108 under the control of the system 100 that is referred to herein.

After a period of time, such as from about 30 seconds to about 90 seconds, for example, the RF source 102, the RF network 106, and the accelerator 104 will have warmed-up and approached or reached their thermal equilibrium states, reducing or eliminating their contribution to instability. When it is desired to generate a radiation beam, the operator sends a beam "on" command to the controller 114 over line 122. In response, the controller 114 enters a beam generation mode to gate the switch 112 to an on state or position to allow electrical power from the electric power supply 110 to be provided to the charged particle source 108. Electric power continues to be provided to the RF source 102. As electric power is received by the charged particle source 106, charged particles, such as electrons, are injected into the accelerator 104 for acceleration by the RF power propagating in the accelerator. The accelerated electrons are directed toward the target 116, comprising target material, such as tungsten, for example, to generate a continuous or pulsed beam of X-ray radiation, as is known in the art. In Varian Linatrons® for example, during the beam-on period, such radiation pulses are a few microseconds in length and the pulse repetition rate is up to several hundred pulses per second.

When radiation is no longer needed, in one example, the operator sends a beam-off command along line 124. In response to the beam-off command, the controller 114 returns to its warm-up mode, gating the switch 112 to an off state or position blocking electrical power to the particle source 108, while maintaining the electric power supply in an "on" state to continue to supply electric power to the RF source 102. Particle injection ceases. However, since RF power continues to be supplied to the RF network 106 and the accelerator 104, these components are maintained at or near their beam-on thermal equilibrium temperatures and conditions. The next time radiation generation is required these components will already be at or near thermal equilibrium. The warm-up period may not be needed, or may be shorter than when the system is first warmed up after the components reached their beam-off thermal equilibrium states.

In this example, an operator decides when to input the warm-up command and when to input the beam-on command. The controller 114 may instead be configured to implement the warm-up mode upon receipt of a beam-on command, and at a predetermined period of the time after the start of the warm-up time period, enter the beam generation mode, turning the switch 112 "on" for radiation generation. As discussed above, the predetermined period of time may be about 30 seconds to about 90 seconds, for example. The predetermined period of time may vary based on the particular system 100 and its environment, as well as the desired stability.

The controller 24 may be programmed in software and/or hardware to operate as described herein.

In another example of operation of the system 100 and other embodiments of the invention, when the beam-off command is received, the controller 114 turns off the electric power supply 110. No electric power will then be provided to either the RF source 102 or the charged particle source 106. The RF source 102, the RF network 106, and the accelerator 104 will transition toward their beam-off equilibrium conditions. If too much time passes before the next beam-on command, such as about 15 minutes, for example, the RF source 102, RF network 106, and the accelerator 104 will return to their beam-off temperature equilibrium states and warm-up, as described above, will be required to avoid instability in the next radiation beam.

In cargo imaging and material discrimination, for example, a dose rate variation of less than about 5% or less than about 3% across each beam-on period would be acceptable. Energy typically needs to be stable to less than about 1% or less, such as from about 0.6% to about 0.7%, for example. These are only examples. The predetermined period of time for a particular system 100 to warm-up sufficiently to reach desired levels of stability may be determined based on testing of the system 100 after installation and/or lab testing of the same or similar systems.

Figure 5:
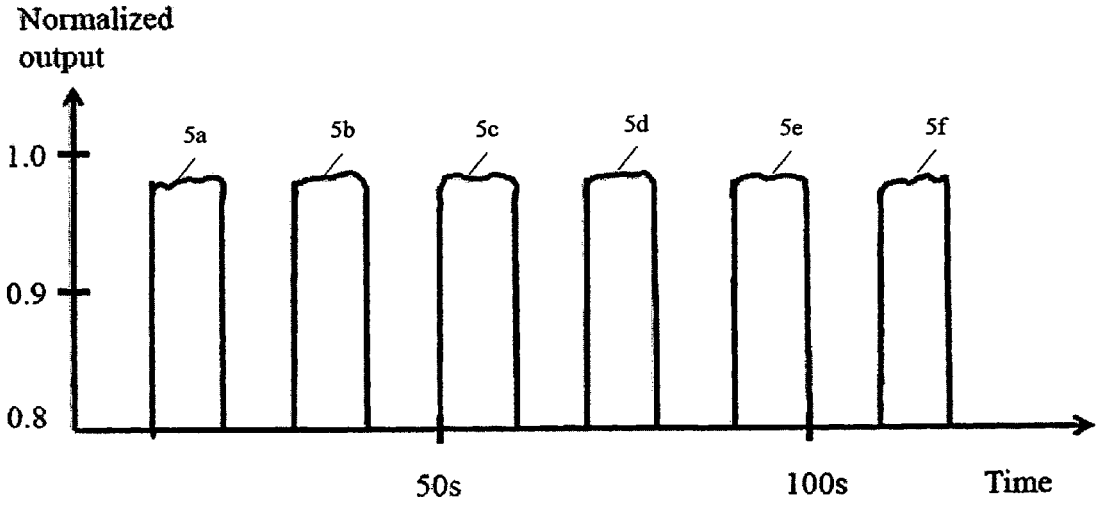
FIG. 5 is a graph of the normalized radiation dose rate versus time for a series of radiation beams, in accordance with the first embodiment.

FIG. 5 is a graph of normalized radiation dose rate versus time for a series of radiation beam-on/off cycles for a Varian M9 Linatron®, discussed above, operated in accordance with this embodiment. The Varian M9 Linatron® includes an electrically controlled mechanical switch between the high voltage electric power supply and the charged particle source to set the charged particle input for operation of the Linatron® at different energies. During a warm-up period, electric power was provided by the source 110 to the RF source 102 without providing electric power to the charged particle source 108, by switching the power provided to the charged particle source from an active tap, during pulse generation, to an open connection, between beam-on periods. Each beam-on period had a length of 10 seconds separated by 10 second warm-up periods without beam generation. The variation in dose rate from the beginning of each beam-on period to the end of each beam-on period varied by about 1%.

In accordance with another embodiment of the invention, delivery of electric power pulses to the RF source 102 and the charged particle source 108 from the electric power supply is offset in time so that there is no overlap between RF pulses and particle injection prior to a beam-on signal. Both the RF source 102/RF network 106, and the charged particle source 108 are warmed up, but charged particles injected into the accelerator 104 by the charged particle source 108 are not accelerated and radiation is not generated from impact of those charged particles injected on the target 110.

Figure 1:
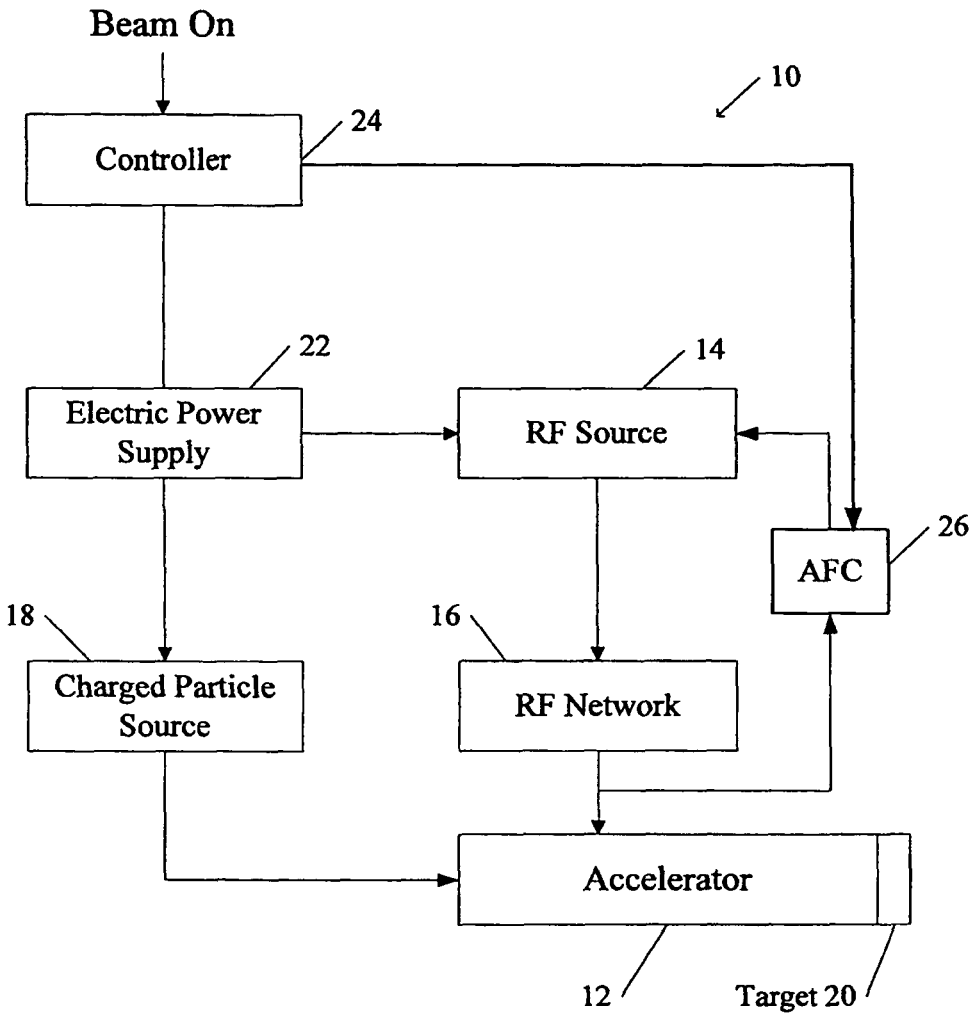
FIG. 1 is a block diagram of major components of an example of an RF accelerator system configured to generate radiation.
Figure 2:
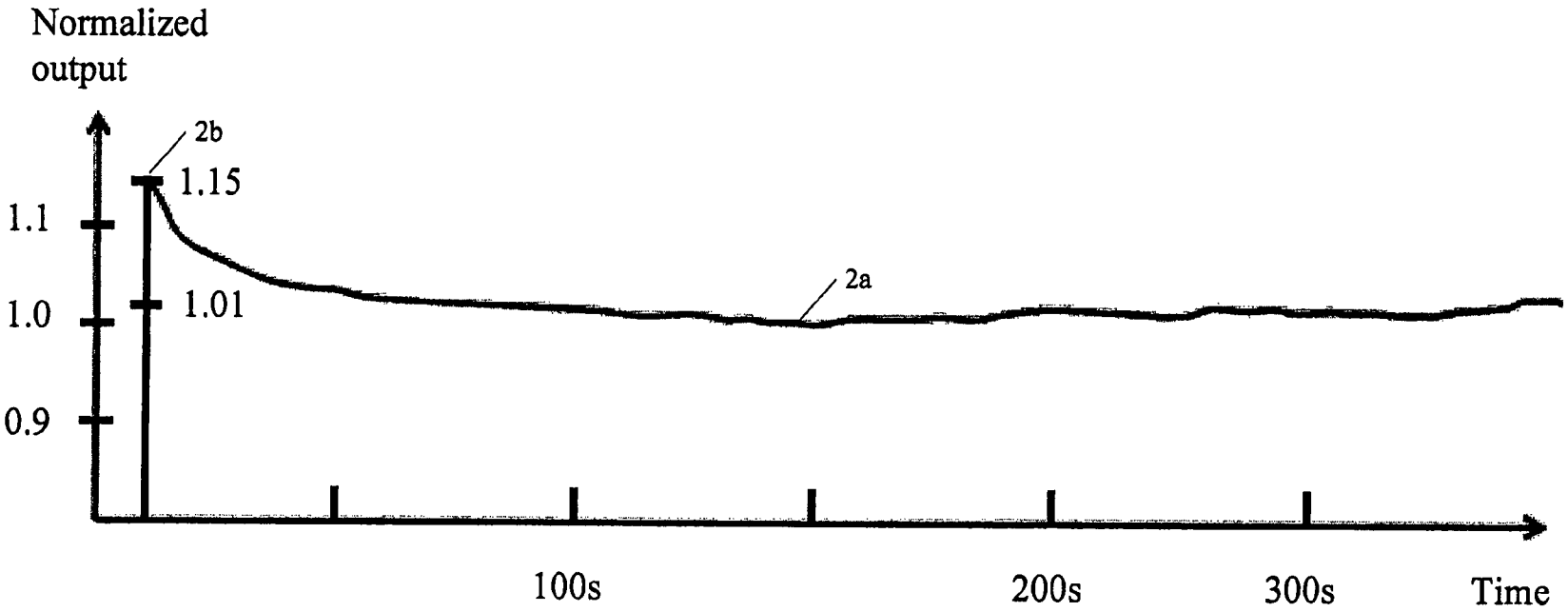
FIG. 2 is a graph of normalized radiation dose versus time for a continuous radiation beam generated by an RF accelerator.
Figure 3:
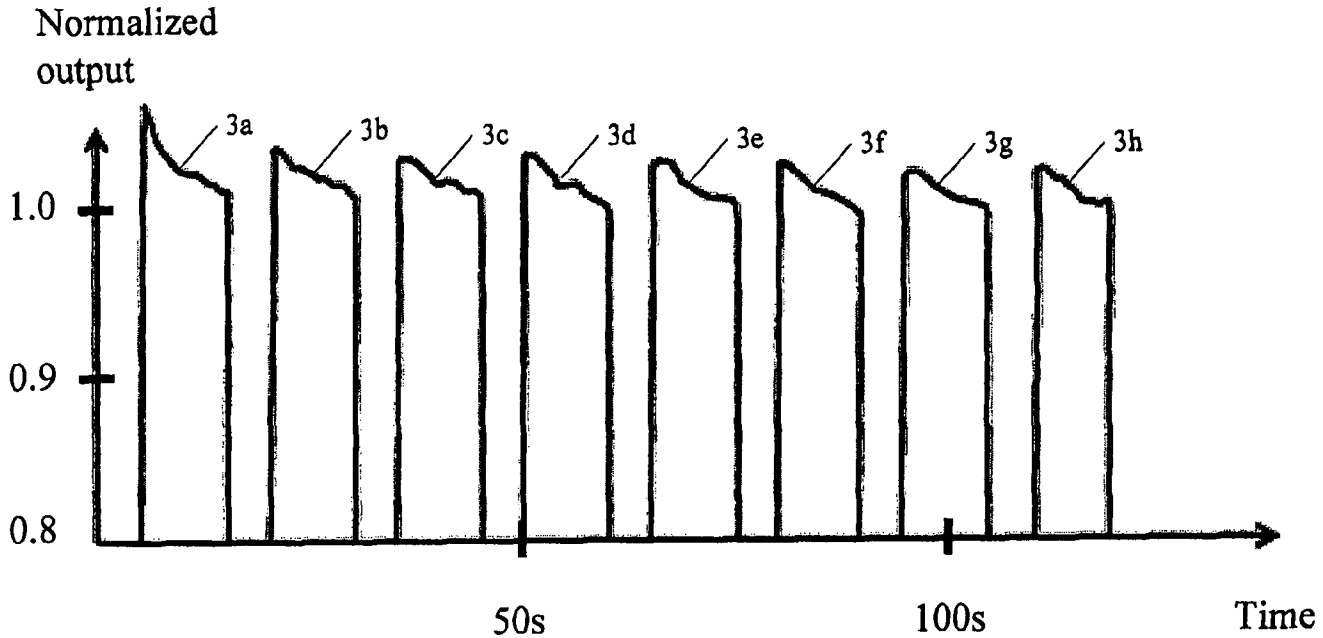
FIG. 3 is a graph of normalized radiation dose rate versus time for a plurality of radiation beams, by the same RF accelerator used in FIG. 2.
Figure 6:
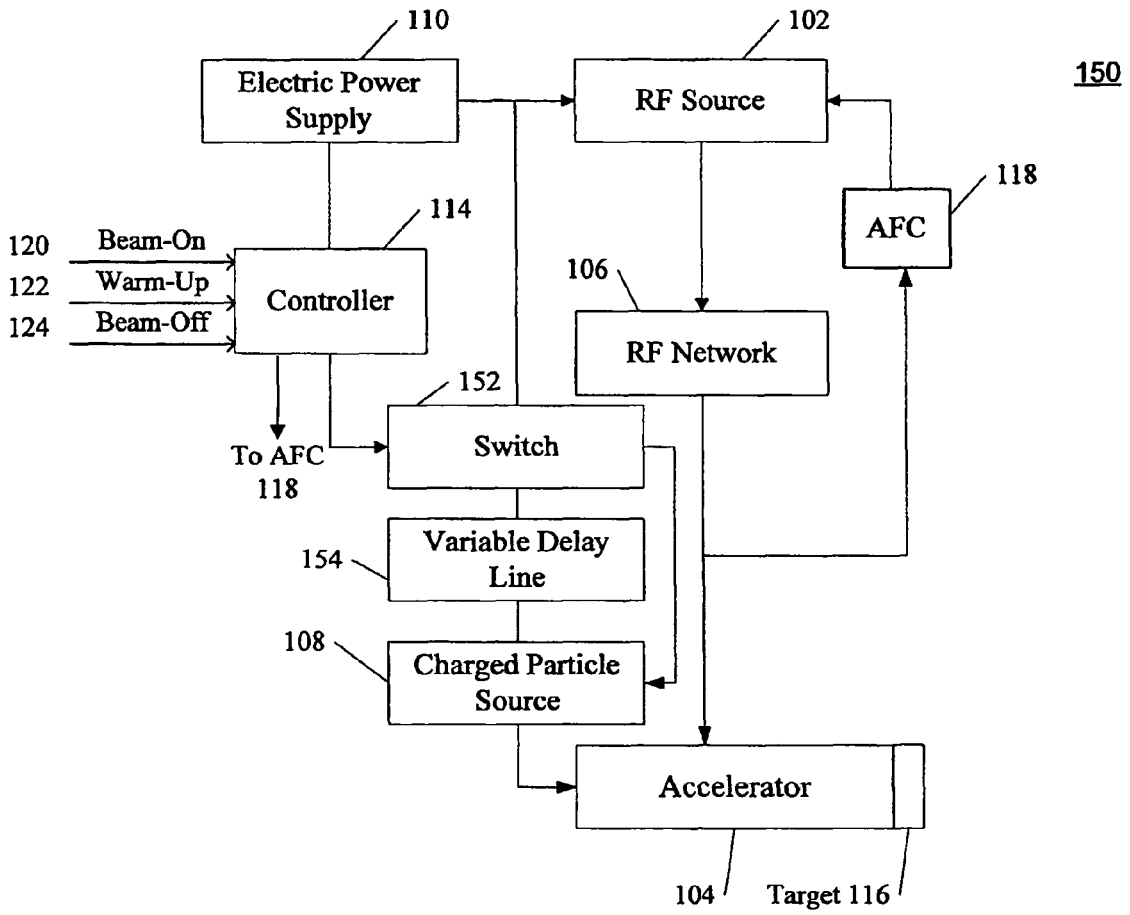
FIG. 6 is a block diagram of an example of a RF accelerator system in accordance with another embodiment of the invention.

FIG. 6 is a block diagram of an example of an RF accelerator system 150 in accordance with this embodiment, in which components common to FIG. 3 are commonly numbered. The system 150 of FIG. 6 comprises the same components as the system 100 of FIG. 3, except that the electric power supply 100, which is electrically coupled to the RF source 102, is also electrically coupled to the charged particle source 108 through a switch 152 and variable delay line ("VDL") 154. The switch 152 is also directly connected to the charged particle source 108. The controller 114 controls operation of the electric power supply 110 and the switch 152 to selectively provide pulsed electric power to either the VDL 152 or directly to the charged particle source 108, while electrical power is being supplied to the RF source 102. The VDL 154 may comprise a network of inductors and capacitors, for example. Suitable VDLs are commercially available.

In one example of the operation of this embodiment, in response to receipt of a warm-up command by the controller 114, the controller 114 operates in a warm-up mode to cause the electric power supply 110 to output electric power to the RF source 102 and to the switch 152. The switch 152 is gated by the controller 114 to a state or position in which the switch 152 directs the pulses of electric power from the electric power supply 110 to the VDL 154, and to block passage of the pulses of electric power directly to the particle source 108. The VDL 154 delays passage of each electrical power pulse to the charged particle source 108 so that when they do arrive at the particle source and charged particles are injected into the accelerator 104, the charged particles do not coincide with the electrical power pulses provided to the RF source 102. The charged particles injected by the charged particle source 108 are not, therefore, accelerated and no radiation is generated. In this example, the delay is at least about 6 microseconds.

When a beam-on command is received by the processor 114, or after the predetermined time period, as discussed above, the controller 114 gates the switch 152 to a state or position to direct electrical power directly to the particle source 108, and not to the VDL 154 so that the electric power pulses arrive at the charged particle source 108 and the RF source 102 at substantially the same time. The pulses of charged particles are therefore injected into the accelerator 104 at substantially the same times as the RF power pulses arrive at the accelerator, causing acceleration of the charged particles and radiation production.

Figure 7:
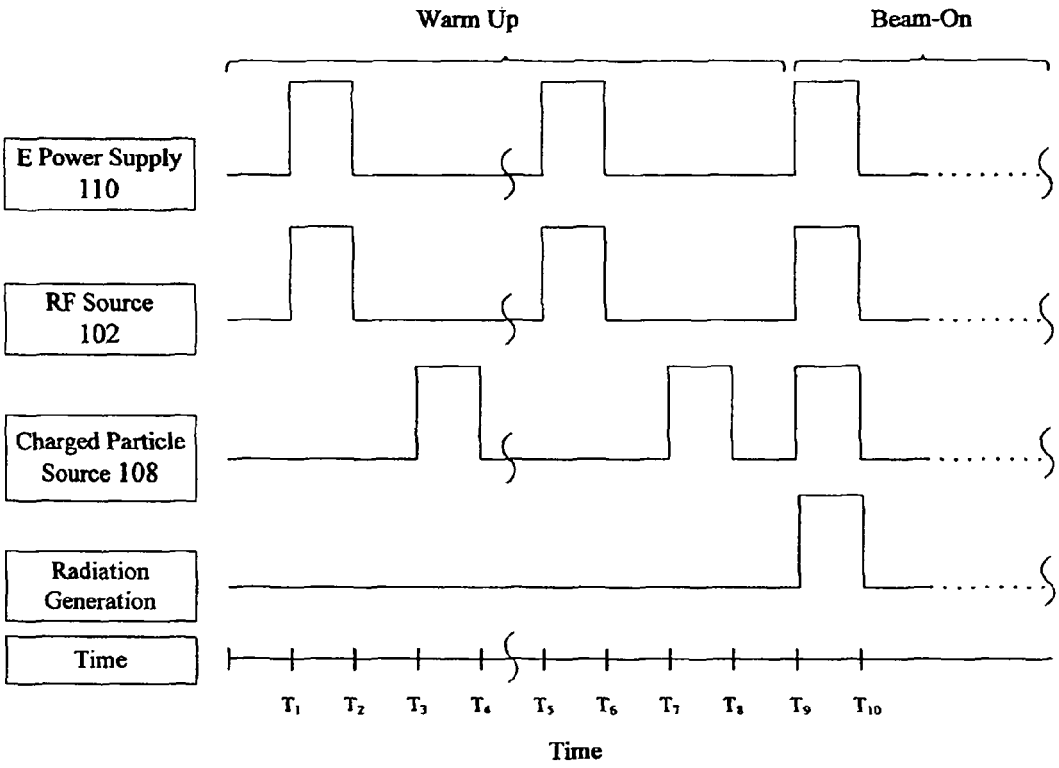
FIG. 7 is an example of a timing diagram for various components of the accelerator system of FIG. 6 during warm-up and beam-on time periods.

FIG. 7 is an example of a timing diagram for various components of the accelerator system of FIG. 6 during warm-up and particle acceleration. During the warm-up time period, while the controller 114 is in the warm-up mode, the controller 114 causes the electric power supply 110 to emit a pulse of electric power, starting at time T1 and ending at time T2. The pulse of electric power is provided to the RF source 102 at substantially the same time, so that they at least partially overlap. In other words "substantially the same time" means that the pulses "at least partially overlap." The VDL 152 delays the arrival of an electric power pulse to the charged particle source 108 until a later time period, starting at T3 and ending at T4. The controller 114 causes another electric power pulse to be emitted from the electric power supply 110, which arrives at the RF source 102, from time T5 to time T6. This pulse arrives at the charged particle source 108 from time T7 to time T8. This is repeated during the warm-up time period up to a few hundred pulses per second, in this example. The warm-up time period may last for 30 to 90 seconds before the start of the beam-on period, for example. No radiation is generated from injected charged particles because the RF power is provided to the RF source 102 and the charged particle source 108 at different times.

When a radiation beam is to be generated, starting at T9 in this example, the controller 114 operates in the beam-on mode to cause the switch 152 to direct the electrical power pulses provided by the electrical power supply 110 to the charged particle source 108, bypassing the VDL 154. An electrical power pulse provided by the electrical power supply 110 from the time T9 to the time T10 arrives at the RF source 102 and the charged particle source 108 at substantially the same time. A radiation beam or radiation beam pulse is therefore generated from the time T9 to the time T10, as charged particles and RF power arrive at the accelerator at substantially the same time. In one example, the time period T9 to T10 is a few microseconds and the controller 114 is operated as described with respect to the T9-T10 time period, a large number of times at a high rate, such as up to a few hundred times per second, during the beam-on time period.

Figure 8:
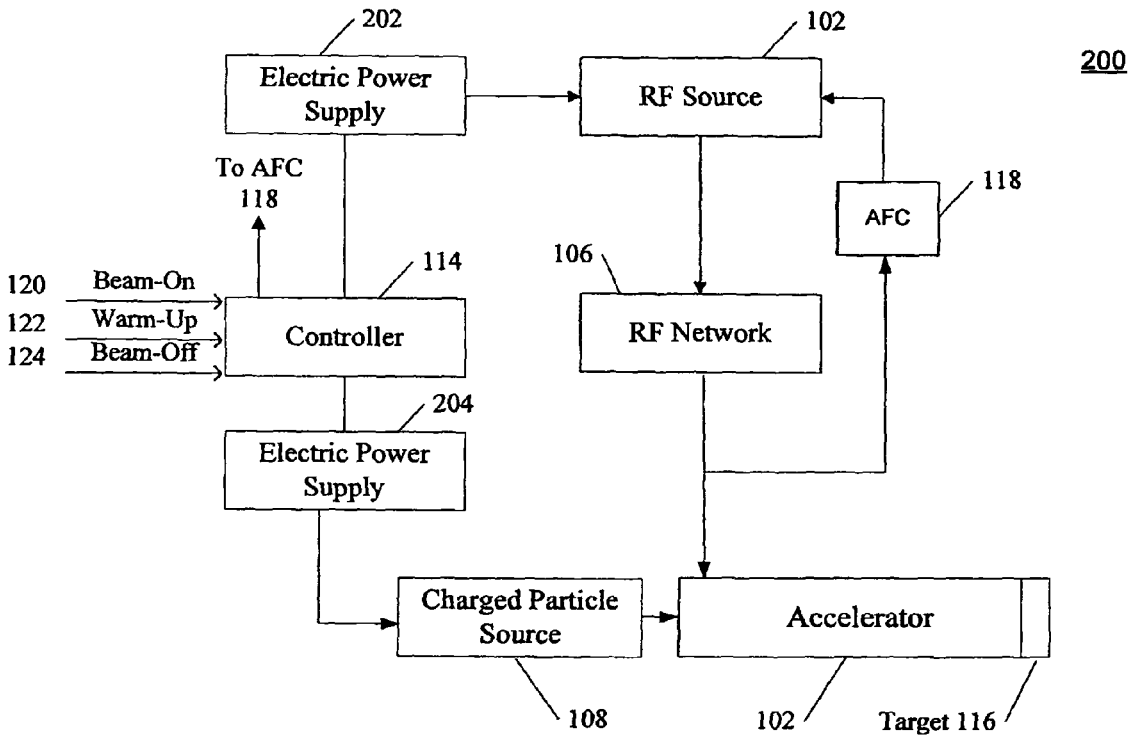
FIG. 8 is an example of a stabilized RF accelerator system in accordance with another embodiment of the invention.

FIG. 8 is an example of a stabilized RF accelerator system 200 in accordance with another embodiment of the invention, where a first electric power source 202 is provided to energize the RF source 102 and a second, separate, electric power source 204 is provided to energize the particle source 108. As above, elements common to FIG. 3 are commonly numbered. When independent electric power sources 202, 204 are used to drive the RF source 102 and the charged particle source 108, the particle source 108 may be energized at different times during the warm-up time period, under the control of the controller 114 while in the warm-up mode. Alternatively, only the RF source 102 may be energized until the RF power components approach or reach their beam-on thermal equilibrium. When radiation generation is desired, the controller 114, operating in the beam-on mode, causes the second electric power supply 204 to provide electric power to the charged particle source at substantially the same time as the first electric power supply provides electric power to the RF components. The injected charged particles are accelerated through the accelerator 102, toward the target 116, as discussed above.

Figure 9:
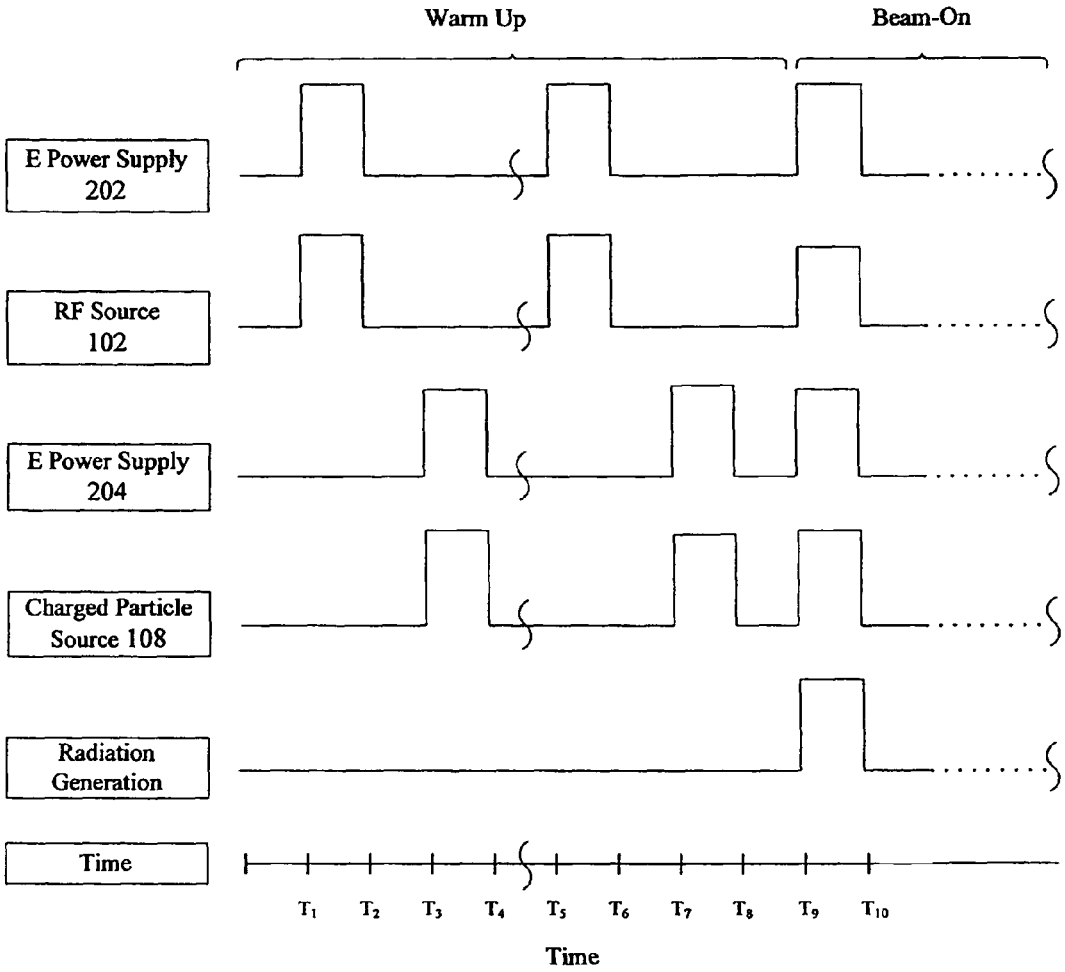
FIG. 9 is an example of a timing diagram for various components of the system of FIG. 8 during warm-up and beam-on time periods.

FIG. 9 is an example of a timing diagram for various components of the system 200 of FIG. 8 during warm-up and beam-on time periods. In this example, during warm-up, the controller 114 causes the first electric power supply 202 to deliver a pulse or a series of pulses of electric power to the RF source 102 starting at a time T1 and ending at a time T2. The controller 114 then causes the second electric power supply 204 to provide a pulse or a series of pulses of electric power to the charged particle source 108 starting at a time T3 and ending at a time T4. The controller causes the first electric power supply 202 to provide another pulse or series of pulses of electric power to the RF source 104 between times T5 and T6, and causes the second electric power source 204 to provide another pulse or series of pulses of electric power to the charged particle source 108, from the times T7 to T8. This may be repeated a many of times during the warm-up period. No radiation is produced, since the electric power is provided to the RF source 102 and the charged particle source 108, at different times.

When a beam-on command is received from an operator, or after the predetermined time period, the controller 114 causes the first and second electric power supplies 202, 204 to provide electric power to the RF source 102 and the charged particle source 108 at substantially the same time so that they at least partially overlap, from the time T9 to the time T10, for example. RF power and charged particles are provided to the accelerator 102 at substantially the same time, resulting in acceleration of the charged particles and radiation generation from the time T9 to the time T10. As discussed above, the time period from T9 to T10 and the generated radiation pulse may be in the microsecond range for example, and may be repeated up to a few hundred times per second during the beam-on time period, for example.

As noted above, the resonance frequency of the accelerator 104 may be affected by electron beam loading. The resonance frequency may, therefore, be different with and without particle injection. In the warm-up mode described in the embodiments above, the AFC 118 may be configured to cause the frequency of the RF source 102 to match the resonance frequency of the accelerator 104 without particle acceleration. When radiation generation is desired and charged particles are injected into the accelerator 104, the resonance frequency of the accelerator shifts. The AFC 118 then causes the frequency of the RF source 102 to shift, to match the current resonance frequency of the accelerator. However, this could take some time and the initial frequency mismatch could cause instability in the radiation beam until the frequencies are matched.

Another embodiment of the invention addresses the difference between the accelerator's resource frequency with and without particle injection. In accordance with this embodiment, faster frequency locking is provided at the start of the beam-on time period by configuring the AFC 118 in any of the embodiments above or other configurations to match the frequency of the RF source 102 to the expected frequency of the accelerator 102 with particle injection, just prior to particle acceleration. In this way, the resonance frequency of the accelerator 102 prior to particle acceleration is closer to the actual resonance frequency of the accelerator when particle acceleration starts.

In one example, the controller 114 or other such controller is configured to cause the AFC 118 to match the frequency of the RF source, such as the RF source 102 in FIG. 4 or FIG. 8, to the resonance frequency of the accelerator 102, plus a small delta (Δ) that accounts for the difference between the expected resonance frequency with and without particle injection, before particle acceleration begins in the beam-on time period. As discussed above, in the beam-on time period electric power is provided to both the RF source 102/RF network 106, and the charged particle source 108 at substantially the same time. The controller 114 may be configured to cause the AFC 118 to match the expected resonant frequency of the RF source 102 in response to the beam-on command, prior to the start of the beam-on time period, for example. The matching of the expected frequency by addition of the delta (Δ) may begin toward the end of the warm-up time period and continue until just prior to the first beam-on electric power pulse. The delta (Δ) may be added one or more times prior to the first beam-on electric power pulse. In one example, the addition of the delta (Δ) to match expected frequency takes place when the beam-on command is received, in a time period between the last warm-up electric power pulse and before the first beam-on electric power pulse. By the start of the first beam-on pulse, the AFC 118 resumes normal operation to match the frequency of the RF source 102 to the actual resonance frequency of the accelerator 104 during particle acceleration and radiation beam generation, as is known in the art.

Figure 10:
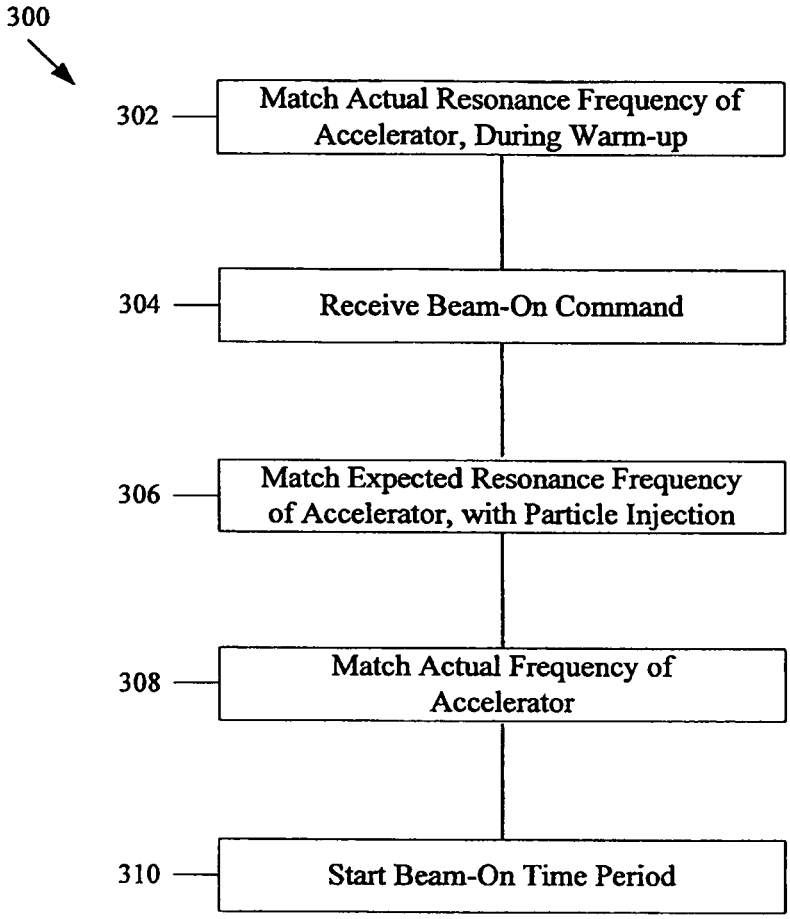
FIG. 10 is an example of a timing diagram for various components of the system of FIG. 8 during warm-up and beam-on time periods, in accordance with another embodiment of the invention.

FIG. 10 is an example of a method 300 of operating the AFC 118 in this embodiment of the invention. During the warm-up time period, the AFC 118 matches the actual resonance frequency of the accelerator 104, in step 302. A beam-on command is received by the controller 114, in this example, in step 304. The controller 114 causes the AFC 118 to match the expected resonance frequency of the accelerator 104 in response to the beam-on command, in step 306, as discussed above. By the time of the first beam-on electric power pulse, the AFC 118 returns to normal operation, matching the actual resonance frequency of the accelerator 104 during the beam-on time period, in step 308. The controller 114 then causes the system to operate during the beam-on time period, in step 310, in which charged particles are injected into the accelerator 102 while RF power is provided to the accelerator 104, for particle acceleration. This is accomplished in the examples above by suitable control of the switch 112 in the embodiment of FIG. 4, the switch 152 in the embodiment of FIG. 6, or by suitable control of the two electric power supplies 202 and 204 in the embodiment of FIG. 8, for example.

Where receipt of the beam-on command starts a predetermined warm-up time period having a predetermined length prior to the beam-on time period, as discussed above, the controller 114 is configured by suitable programming or hardware configuration to cause the AFC 118 to match the expected resonance frequency of the accelerator 102 by addition of the delta (Δ) at an appropriate time, such as just after the last pulse in the warm-up time period and prior to starting the beam-on time period, as above.

Figure 11:
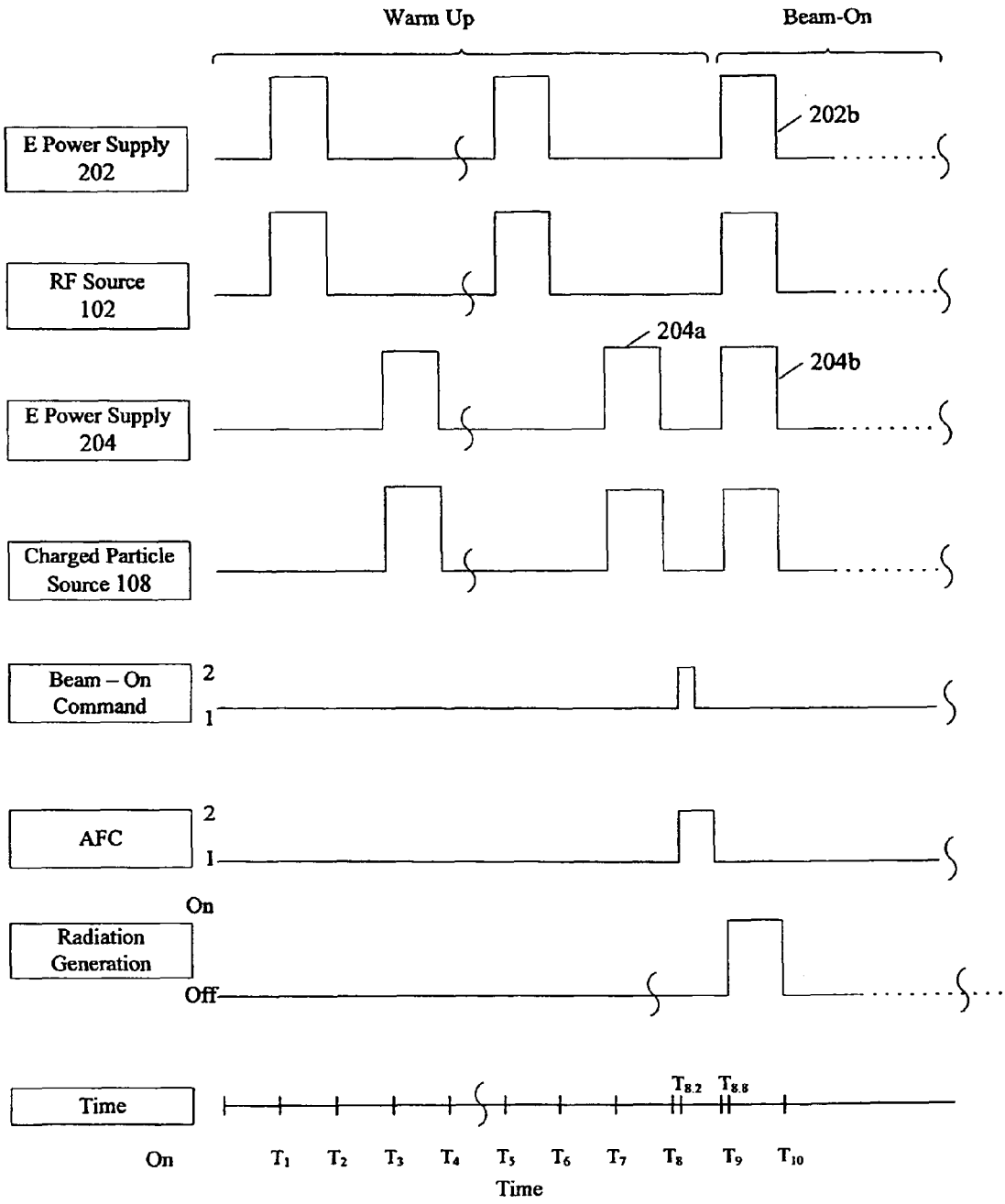
FIG. 11 is an example of a method in accordance with the embodiment of FIG. 10.

FIG. 11 is an example of a timing diagram of the system of FIG. 8 incorporating an example of this embodiment of the invention. FIG. 11 is the same as FIG. 9, except that timing lines for the beam-on command and the AFC 118 are included. During the warm-up time period, the AFC 118 is in a first state 1, matching the actual resonance frequency of the accelerator 102. In this example, preparation for the beam-on time period begins at a time T8.2, automatically by the controller 114 or in response to a beam-on command, as discussed above, in the warm-up period. In this example, the time T8.2 is after the end of the last pulse 204*a* generated by the electric power supply 204 and provided to the charged particle source 108. At the time T8.2, the state AFC 118 is changed to a second state 2, in which the AFC matches the expected resonance frequency of the accelerator 102 with particle injection, as discussed above.

The beam-on time period starts at the time T9. The AFC 118 is in the second state until a time just prior to the time T9, such as the T8.8, when it returns to the state 1 matching the actual resonance frequency of the accelerator 102. At the time T9 first pulses 202*a*, 204*b* of electric power start to be provided by the first and second electric power supplies 202, 204, respectively, to the RF source 102 and the charged particle source 108 at substantially the same time (at the same time in this example), to cause particle acceleration and radiation generation. In the other examples, above, the first electric power pulse would be generated by the one electric power supply 110.

In each of the embodiments described above, the accelerated charged particles may also be used directly, such as for radiation therapy. In that case, the target 120 would not be provided.

Although the above description refers to a steady state RF accelerator based radiation source where all pulses are the same, the embodiments of the invention described above also apply to multi-energy accelerator systems, where characteristics of the radiation pulses vary, as described in the '563 Publication, which is incorporated by reference herein. It is also applicable to variable dose output accelerators.

Although in these examples the charged particle source 108 is energized after the RF source 102 during the warm-up period, it can also be energized before. As long as there is no overlap, no radiation beam will be produced from charged particles injected by the charges particle source 108 before the components approach or reach beam-on thermal equilibrium.

One of the ordinary skill in the art will recognize that other changes may be made to the embodiments described above without departing from the spirit and scope of the invention, which is defined by the claims below.

We claim:

1. A stabilized radio-frequency ("RF") accelerator system, comprising:

an RF accelerator to accelerate charged particles;

an RF source coupled to the accelerator to provide RF power into the accelerator;

a charged particle source coupled to the accelerator to inject charged particles into the accelerator;

at least one high voltage electric power supply coupled to the RF source and the charged particle source to provide electric power thereto;

at least one controller configured to:

cause supply of high voltage electric power from the at least one high voltage electric power supply to at least one of the RF source or the charged particle source without accelerating charged particles injected by the charged particle source, during a warm-up time period; and cause supply of high voltage electric power from the at least one high voltage electric power supply to the RF source and to the charged particle source during at least partially overlapping times, to accelerate charged particles injected by the charged particle source, during a beam-on time period.

2. The accelerator system of claim 1, further comprising an RF network between the RF source and the accelerator.

3. The accelerator system of claim 1, wherein the RF source comprises a klystron or a magnetron.

4. The accelerator system of claim 1, wherein the charged particle source comprises a triode gun or a diode gun.

5. The system of claim 1, further comprising:

a switch between the at least one high voltage electric power supply and the charged particle source to selectively allow passage of high voltage electric power to the particle source;

wherein the controller is configured to selectively control the switch to block passage of high voltage electric power to the charged particle source during the warm-up time period and allow passage of high voltage electric power to the RF source during the beam-on time period.

6. The accelerator system of claim 1, wherein the at least one controller is configured to cause supply of high voltage electric power from the at least one high voltage electric power supply to the RF source and to the charged particle source at different times during the warm-up time period.

7. The system of claim 6, further comprising:

a variable delay line between the at least one high voltage electric power supply and the charged particle source; and a switch between the at least one high voltage electric power supply and the variable delay line to selectively direct high voltage electric power to the charged particle source through the variable delay line or to direct high voltage electric power to the charged particle source, bypassing the variable delay line;

wherein the controller is configured to control the switch to:

direct high voltage electric power to the charged particle source through the variable delay line during the warm-up time period, such that the high voltage electric power arrives at the charged particle source during first time periods and the high voltage electric power arrives at the RF source during second time periods that do not overlap with the first time periods; and direct electric power to the charged particle source during the beam-on time period, bypassing the variable delay line, such that high voltage electric power arrives at the charged particle source at third time periods and the high voltage electric power arrives at the RF source during fourth time periods at least partially overlapping with the third time periods.

8. The system of claim 1, wherein the at least one high voltage electric power supply comprises:

a first high voltage electric power supply to provide electric power to the RF source and;

a second high voltage electric power supply separate from the first high voltage electric power supply, to provide high voltage electric power to the particle source;

wherein the controller is configured to:

activate the first and second high voltage electric power supplies at different, non-overlapping time periods within the warm-up time period; and activate the first and second high voltage electric power supplies during at least partially overlapping time periods within the beam-on time period.

9. The system of claim 1, further comprising:

a target material positioned to be impacted by accelerated charged particles, to cause radiation generation.

10. The system of claim 1, wherein the controller is configured to cause supply of high voltage electric power from the at least one electric power supply to the RF source and the charged particle source without causing acceleration of charged particles injected by the charged particle source, in a second warm-up time period after the beam-on time period.

11. The system of claim 1, further comprising an automatic frequency controller between the RF source and the accelerator, wherein the first controller is configured to:

cause the automatic frequency controller to match the actual frequency of the RF source to the resonance frequency of the accelerator without particle injection, during the warm-up time period;

cause the automatic frequency controller to match the expected frequency of the accelerator with particle injection prior to a start of the beam-on time period; and cause the automatic frequency controller to match the actual resonance frequency of the accelerator during acceleration of injected charged particles at the start of the beam-on time period.

12. The system of claim 11, wherein the first controller is configured to:

cause supply of pulses of high voltage electric power to at least one of the RF source or the charged particle source during the warm-up time period;

cause supply of at least partially overlapping pulses of high voltage electric power to the RF source and the charged particle source during the beam-on time period; and cause the automatic frequency controller to match the frequency of the RF source to the expected resonance frequency of the accelerator with particle injection in a time period between a last pulse in the warm-up time period and a first pulse in the beam-on time period.

13. A stabilized radio-frequency ("RF") accelerator system, comprising:

RF accelerator means for accelerating charged particles;

RF power means for providing RF power to the RF accelerator means;

charged particle means for providing charged particles to the RF accelerator means;

high voltage electric power means for providing high voltage electric power to the RF source and the charged particle source;

means for causing supply of high voltage electric power to at least one of the RF power means or the charged particle means without accelerating charged particles injected into the accelerator by the charged particle means, during a warm-up time period; and means for causing supply of high voltage electric power to both the RF power means and the charged particle means to cause acceleration of charged particles, during at least partially overlapping time periods within a beam-on time period.

14. A method for generating stabilized particle acceleration by a radio-frequency (RF) accelerator, comprising:

supplying high voltage electric power to, a radio-frequency ("RF") source coupled to the accelerator during at least one first time period during a warm-up mode within a warm-up time period;

operating the accelerator in the warm-up mode during the warm-up time period, without accelerating charged particles injected by a charged particle source; and operating the accelerator in a beam-on mode during a beam-on time period after the warm-up time period, to accelerate charged particles injected by the charged particle source.

15. The method of claim 14, wherein:

the beam-on mode comprises:

supplying high voltage electric power to the RF source during at least one second time period within the beam-on time period;

supplying high voltage electric power to the charged particle source during at least one third time period within the beam-on time period, wherein at least certain of the at least one third time periods at least partially overlaps at least certain of the respective second time periods; and accelerating the charged particles by the accelerator, during the at least partially overlapping second and third time periods.

16. The method of claim 15, wherein the warm-up mode further comprises:

supplying high voltage electric power to the charged particle source during at least one fourth time period different from each of the at least one first time periods, within the warm-up time period, wherein each of the at least one fourth time periods and each of the at least one first time periods are non-overlapping.

17. The method of claim 16, wherein the warm-up mode comprises:

supplying non-overlapping pulses of high voltage electric power to the RF source and to the charged particle source during a plurality of different, non-overlapping, first and fourth time periods, during the warm-up period; and the beam-on time period comprises:

supplying pulses of high voltage electric power to the RF source and to the charged particle source during a plurality of at least partially overlapping second and third time periods, during the beam-on time period.

18. The method of claim 15, comprising supplying the high voltage electric power to the charged particle source and to the RF source during the third and fourth, non-overlapping time periods by delaying the high voltage electric power provided to the charged particle source, with respect to the high voltage electric power provided to the RF source.

19. The method of claim 14, further comprising, while in the beam-on time period:

impacting a target by the accelerated charged particles, during the beam-on time period; and generating radiation from impact of the accelerated charged particles on the target.

20. The method of claim 15, comprising:

supplying high voltage electric power to the RF source by a first high voltage electric power supply; and supplying high voltage electric power to the charged particle source by a second high voltage electric power supply different from the first high voltage electric power supply.

21. The method of claim 14, further comprising:

matching a frequency of the RF source to the actual resonance frequency of the accelerator without particle injection, during the warm-up time period;

matching the frequency of the RF source to the expected frequency of the accelerator during charged particle injection, prior to a start of the beam-on time period; and matching the frequency of the RF source to the actual resonance frequency of the accelerator, during acceleration of injected charged particles, during the beam-on time period.

22. The method of claim 21, comprising:

causing supply of high voltage electric power pulses to at least one of the RF source and the charged particle source, during the warm-up time period;

causing supply of at least partially overlapping pulses of high voltage electric power to the RF source and the charged particle source, during the beam-on time period; and matching the frequency of the RF source to the expected frequency of the accelerator during particle acceleration in a time period between a last high voltage electric power pulse in the warm-up time period and a first electric power pulse in the beam-on time period, prior to acceleration of injected charged particles.

* * * * *